US011658430B2

(12) United States Patent
Stolze

(10) Patent No.: US 11,658,430 B2
(45) Date of Patent: May 23, 2023

(54) CONNECTING TERMINAL

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 257 days.

(21) Appl. No.: 17/165,250

(22) Filed: Feb. 2, 2021

(65) Prior Publication Data

US 2021/0242612 A1 Aug. 5, 2021

(30) Foreign Application Priority Data

Feb. 3, 2020 (DE) ..... 20 2020 100 565.0

(51) Int. Cl.
*H01R 9/24* (2006.01)
*H01R 9/22* (2006.01)

(52) U.S. Cl.
CPC ..... *H01R 9/2458* (2013.01); *H01R 9/223* (2013.01); *H01R 9/2408* (2013.01); *H01R 9/2416* (2013.01)

(58) Field of Classification Search
CPC .... H01R 41/00; H01R 6/2458; H01R 9/2408; H01R 9/2416
USPC ..... 439/11, 31, 32
See application file for complete search history.

(56) References Cited

U.S. PATENT DOCUMENTS

| | | | | |
|---|---|---|---|---|
| 7,547,235 | B2 * | 6/2009 | Hasid | H01R 25/006 439/652 |
| 7,845,969 | B2 * | 12/2010 | Stadler | H01R 9/2491 439/441 |
| 9,147,985 | B1 * | 9/2015 | Noriega | H01R 25/003 |
| 9,525,252 | B2 * | 12/2016 | Kim | H01R 35/04 |
| 10,333,232 | B2 * | 6/2019 | Wu | H01R 9/2416 |
| 2006/0234561 | A1 * | 10/2006 | Tanaka | H01R 25/003 439/652 |
| 2013/0034997 | A1 | 2/2013 | Yang | |

* cited by examiner

*Primary Examiner* — Oscar C Jimenez
*Assistant Examiner* — Paul D Baillargeon
(74) *Attorney, Agent, or Firm* — Muncy, Geissler, Olds & Lowe, P.C.

(57) ABSTRACT

A connecting terminal having a plurality of conductor connection modules, wherein the conductor connection modules each have an insulating material housing with a conductor insertion opening for receiving an electrical conductor. In each case two conductor connection modules arranged next to one another are connected via a web, wherein the web is designed flexibly in such a way that the conductor connection modules can be arranged from an initial position into an arrangement different from the initial position, and vice versa.

14 Claims, 7 Drawing Sheets

CONNECTING TERMINAL

This nonprovisional application claims priority under 35 U.S.C. § 119(a) to German Patent Application No. 20 2020 100 565.0, which was filed in Germany on Feb. 3, 2020 and which is herein incorporated by reference.

BACKGROUND OF THE INVENTION

Field of the Invention

The present invention relates to a connecting terminal having a plurality of conductor connection modules, wherein the conductor connection modules each have an insulating material housing with a conductor insertion opening for receiving an electrical conductor.

Description of the Background Art

US Pat. 2013/0034997 A1 describes an electrical connecting terminal with four conductor connection modules, each for connecting an electrical conductor. The conductor connection modules are arranged in an arc shape in an insulating material housing. An actuating lever of a connection module can be used to open or close a clamping point for the electrical conductor.

A disadvantage of such connecting terminals can be the rigid design of the connecting terminal. The conductor connection modules of such connecting terminals have a mandatory predefined conductor connection direction due to the predefined shape of the insulating material housing. As a result, the connecting terminal can only be mounted in this predetermined shape and cannot be adapted to different conditions, such as reduced installation space.

SUMMARY OF THE INVENTION

It is therefore an object of the present invention to provide an improved connecting terminal.

In a connecting terminal, it is proposed that in each case two conductor connection modules arranged next to one another and are connected via a web, wherein the web is designed flexibly in such a way that the conductor connection modules can be arranged from an initial position to an arrangement different from the initial position, and vice versa.

The flexible design of the web makes it possible to arrange the conductor connection modules in an arrangement different from the initial position. In this way, the connecting terminal can be flexibly adapted to different conditions or structural specifications.

Adjacent conductor connection modules and the webs connected to the conductor connection modules form a conductor connection strand as a whole. By forming a conductor connection strand, several conductor connection modules can be mounted at the same time. This offers an assembly advantage over individual conductor connection modules.

The term "adjacent" includes directly adjacent and not directly (indirectly) adjacent. Not directly adjacent means that at least one component is located between the conductor connection modules.

Flexibility can be achieved, for example, by selecting a suitable material, such as a flexible plastic. The webs thus have a sufficiently high elasticity, i.e. the property of changing its shape when a force is applied and returning to its original shape when the applied force is removed, so that no deformation of the connecting terminal occurs. Deformation, as is possible with rigid connecting terminals, can cause damage to the connecting terminal, which can lead to a loss of function of the connecting terminal. However, it is also conceivable that a hinge is built into the webs, or that the webs themselves are designed in a hinge-like manner, so that the conductor connection modules can be brought into a desired arrangement via a hinged connection with, for example, a fixed axis of rotation.

Flexible means in particular that the conductor connection modules can be returned to their initial position. For example, the conductor connection modules can be moved from a linear arrangement to an arc-shaped arrangement, and vice versa. Arc-shaped means in particular that the conductor connection modules can be arranged on an arc with a defined radius. Both large and small radii are conceivable.

However, other initial positions are also conceivable, wherein the conductor connection modules can be brought into arrangements different from the initial position. For example, the conductor connection modules can also be brought from an arc-shaped initial position into a linear arrangement. It is also conceivable that the conductor connection modules can be brought from any initial position, in particular a linear initial position, into a serpentine or S-shaped arrangement or into a partially linear arrangement and into a partially arc-shaped arrangement, and vice versa.

If there are only two conductor connection modules, the initial position can be determined on the basis of the angle to each other, wherein in an arrangement different from the initial position, the angle between the conductor connection modules is larger or smaller.

It is conceivable that all conductor insertion openings of the respective conductor connection modules are aligned towards the same side. However, it is also possible that the conductor insertion openings of the conductor connection modules are arranged in different orientations on the conductor connection modules. In the case of an arc-shaped arrangement of the conductor connection modules, for example, the conductor insertion openings can be arranged on an inner and/or on an outer radius of the arc.

Two adjacent conductor connection modules, or the housings of the adjacent conductor connection modules, and the web connecting the adjacent conductor connection modules, or the housings of the adjacent conductor connection modules, can be formed in one piece.

The one-piece design optimizes the manufacturing process and thus saves costs, as the conductor connection strand can be manufactured with a reduced number of work steps as compared to separately designing the conductor connection modules and the webs. This also improves the flexibility of the webs and the conductor connection strand, since the webs do not have to be additionally connected to the conductor connection modules using a joining process.

However, it is also conceivable that a one-piece web is formed on which the conductor connection modules can be arranged.

A contact insert can be arranged in at least one conductor connection module, wherein the contact insert has, for example, a busbar piece and a clamping spring for clamping the electrical conductor, the busbar piece and the clamping spring forming a clamping point for the electrical conductor to be clamped.

It is conceivable that a contact insert is assigned to each conductor connection module. However, it is also possible that not each conductor connection module is also assigned to a contact insert. For example, only every second conductor connection module of the conductor connection line can be equipped with a contact insert. In this way, the connecting terminal can be individually adapted to the respective conditions.

The connecting terminal may have an actuating lever, wherein the actuating lever is configured to open and/or close the clamping point.

In this way, the handling of a connecting terminal according to the invention can be improved in that the clamping point can be opened and/or closed without additional actuation tools.

A fork contact for contacting a contact pin can be arranged on the busbar piece.

The fork contact makes it possible to additionally make electrically conductive contact with the respective conductor connection modules via a contact pin. In particular, the fork contact can be designed in such a way that the contact pin can be inserted into the fork contact transversely, i.e. substantially perpendicular to the conductor insertion direction. The fork contact can thus be inserted vertically into the fork contact or horizontally, from the side, to the fork contact.

The busbar section can have a contact opening to accommodate a bridge or a switching spring.

Conductor connection modules can be electrically connected to each other via the bridge. This connection does not necessarily have to be made between adjacent conductor connection modules, but can also be made by omitting a conductor connection module.

Two conductor connection modules can also be electrically conductively connected to each other by means of a switching spring. In contrast to the bridge, the switching spring has an actuating section, wherein the electrically conductive connection of the connected conductor connection modules is disconnected or established under the application of force on the actuating section. The force can be applied, for example, by inserting a contact pin into the fork contact.

A conductor insertion contour may protrude from the busbar piece to guide the electrical conductor.

The conductor insertion contour allows for the electrical conductor to be guided safely to the clamping point. The conductor insertion contour can, for example, be formed in one piece from the busbar section and bent over into the area of the conductor insertion opening and/or clamping point. However, it is also conceivable that the conductor insertion contour is formed from an insulating material housing which projects into the region of the clamping point and/or the conductor insertion opening. The contour can be designed, for example, as a conductor guide bevel which guides an electrical conductor towards the clamping point.

The connecting terminal may have at least one mounting tab for mounting the connecting terminal to or in a housing or other substrate.

The mounting tab is preferably arranged on one of the conductor connection modules, in particular on one of the outer conductor connection modules of a conductor connection strand. A mounting tab can also be arranged on one of the outer conductor connection modules in each case. The entire conductor connection strand can be fastened to the mounting location via the mounting tab. It is conceivable that the conductor connection strand can be fixed in its arrangement at the respective mounting location, which differs from the initial position, so that the conductor connection strand cannot be returned to its initial position without releasing the connection.

The mounting tab can be arranged on the side of the conductor connection module or also, for example, in the area in front of a conductor insertion opening. As an alternative to the mounting tab, protruding mounting pins can be provided on the conductor connection modules or also on the webs on an underside facing the mounting surface. The mounting pins can, for example, be accommodated in corresponding recesses in the mounting surface or the mounting base in a form-fitting and/or force-fitting manner or also in a latching manner in order to fix the conductor connection strand in its arrangement, which differs from the initial position, at the respective mounting location.

A cover element can be arranged on the connecting terminal, wherein the cover element is designed to fix the conductor connection modules in the arrangement different from the initial position.

The cover element can be used to fix the conductor connection strand in its arrangement, which differs from the initial position, in a simple manner by attaching the cover element to the conductor connection strand and thus fixing the conductor connection modules in their arrangement relative to one another. The cover element can, for example, be designed so rigidly that deformation of the cover element is not possible due to the elasticity of the conductor connection modules. A possible embodiment of the cover element can be, for example, that the cover element is formed in an arc-shaped shape congruent to the arrangement of the conductor connection modules, so that the conductor connection modules can be fixed in an arc-shaped arrangement. However, fixing the arrangement of the conductor connection modules per se does not mean in particular that the cover element is fixed to the conductor connection strand or to individual conductor connection modules themselves.

Mounting webs may extend from the cover element, wherein the mounting webs extend from the cover element into an intermediate space between two adjacent conductor connection modules.

This can facilitate the positioning of the cover element on or at the conductor connection strand and further improve the stability of the conductor connection strand, as the mounting webs engage precisely in the intermediate space between two adjacent conductor connection modules.

At least one latching element can be arranged on the cover element and/or on the terminal, wherein the latching element fixes the cover element to the connecting terminal.

The latching element can be used to hold the cover element fixed to the connecting terminal so that a change in the arrangement of the conductor connection modules, which differs from the initial position, can be avoided. The latching element can, for example, be arranged on the conductor connection modules and/or the mounting webs of the cover element. In this case, the cover element can be fixed to a base body of the connecting terminal, for example.

The latching element can be designed as a dovetail connection.

A good positive connection of the cover element to the connecting terminal can be achieved, wherein the cover element is fixed to the connecting terminal. The dovetail connection can also be designed as a negative dovetail connection, wherein the dovetail is designed as a recess on the cover element or on the connecting terminal.

The mounting webs can be trapezoidal in shape.

The trapezoidal design of the mounting webs allows for them to protrude precisely into the intermediate space between two adjacent conductor connection modules of an arc-shaped arrangement of the conductor connection modules of a conductor connection strand. The arc-shaped arrangement can create a narrowing intermediate space, with the width of the intermediate space decreasing in the direction of the inner radius of the arc.

The cover element can have a receiving contour for receiving a pin strip. Furthermore, the pin strip may have contact pins, wherein the contact pins are designed for contacting the fork contact.

The additional receiving contour of the cover element allows for a pin strip with contact pins to make contact with existing fork contacts of the conductor connection modules. This saves installation space by allowing the pin strip to be plugged onto the cover element, thus eliminating the need to provide an additional area for contacting the fork contacts.

Furthermore, the invention relates to a method of assembling a connecting terminal according to the invention, comprising the following steps: providing a connecting terminal according to the invention; positioning the connecting terminal at the mounting location and pretensioning the conductor connection modules in an arc-shaped arrangement different from an initial position; and/or fixing the conductor connection modules in the arrangement different from the initial position with the cover element.

The undefined term "a" is to be understood as such and not as a numeral. Thus, it is also conceivable that the conductor connection modules of the connecting terminal according to the invention have several conductor insertion openings, for example two conductor insertion openings. It is also conceivable that not only one cover element is used to fix the conductor connection modules in an arrangement different from the initial position, but two cover elements are used to fix one part of the conductor connection strand in a different arrangement than the other part of the conductor connection strand.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
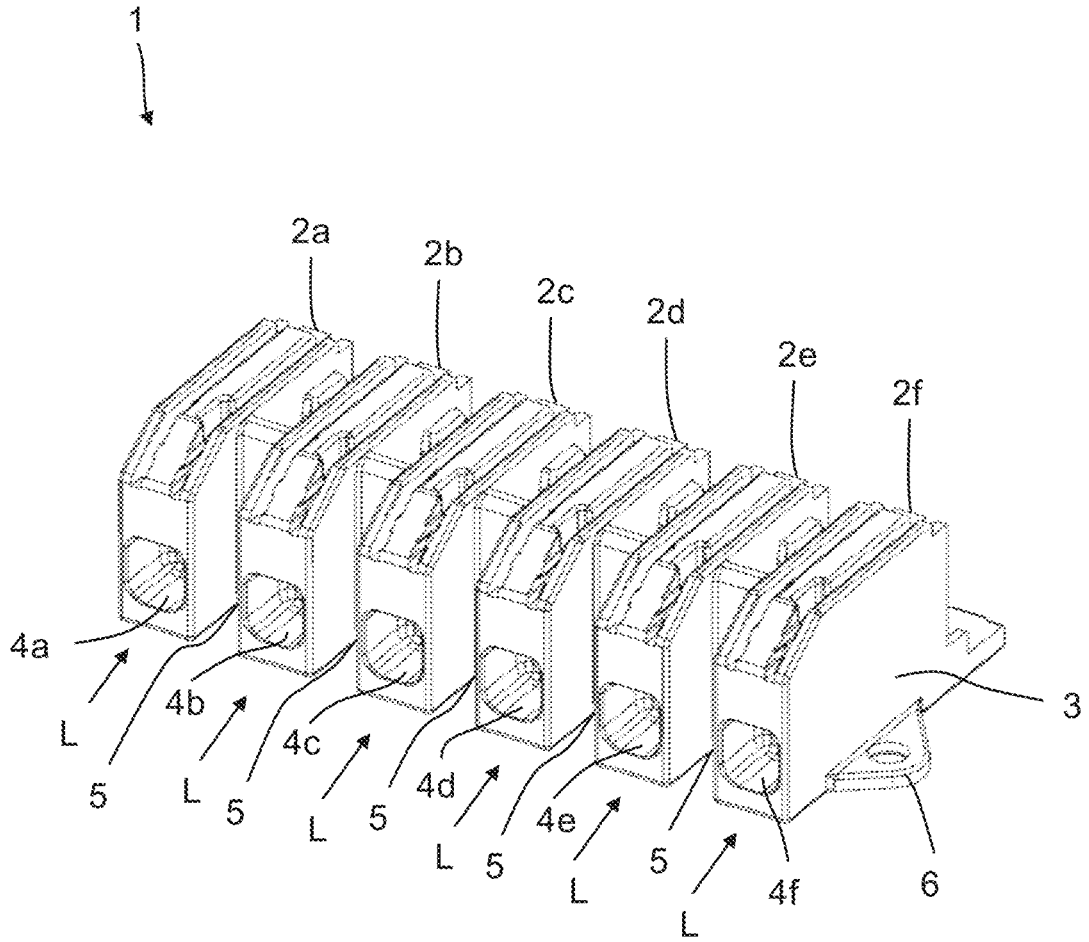
FIG. 1 is an embodiment of a connecting terminal in an initial position.

FIG. 1 shows an exemplary embodiment of a connecting terminal 1 according to the invention in an initial position. The connecting terminal 1 has, for example, six conductor connection modules 2*a*, 2*b*, 2*c*, 2*d*, 2*e*, 2*f*, wherein in each case one of the conductor connection modules 2*a*, 2*b*, 2*c*, 2*d*, 2*e*, 2*f* has an insulating material housing 3 and a conductor insertion opening 4*a*, 4*b*, 4*c*, 4*d*, 4*e*, 4*f* for receiving an electrical conductor. In each case, two conductor connection modules 2*a*, 2*b*, 2*c*, 2*d*, 2*e*, 2*f* arranged next to one another are integrally connected to one another via a web 5. In particular, the insulating material housings 3 of the conductor connection modules 2*a*, 2*b*, 2*c*, 2*d*, 2*e*, 2*f* and the webs 5 are formed in one piece from an electrically insulating plastic, for example by plastic injection molding.

It is clear that the conductor insertion openings 4*a*, 4*b*, 4*c*, 4*d*, 4*e*, 4*f* are arranged at the same position of the respective conductor connection module 2*a*, 2*b*, 2*c*, 2*d*, 2*e*, 2*f*. That is, electrical conductors can be inserted into the conductor connection modules 2*a*, 2*b*, 2*c*, 2*d*, 2*e*, 2*f* from the same side of the connecting terminal 1.

The conductor connection modules 2*a*, 2*b*, 2*c*, 2*d*, 2*e*, 2*f* arranged next to each other form a conductor connection strand with the connected webs 5. It can be seen that the conductor connection modules 2*a*, 2*b*, 2*c*, 2*d*, 2*e*, 2*f* are arranged linearly to one another, i.e. in a row. Linear means in particular that conductor connection modules 2*a*, 2*b*, 2*c*, 2*d*, 2*e*, 2*f* are aligned parallel to one another in such a way that the conductor insertion directions L also run parallel to one another. The entire conductor connection strand thus has no bends. This linear arrangement is the initial position of the conductor connection modules 2*a*, 2*b*, 2*c*, 2*d*, 2*e*, 2*f*. The initial position can, for example, be the position that arises after the connecting terminal 1 has been manufactured. Preferably, the distances between the conductor connection modules 2*a*, 2*b*, 2*c*, 2*d*, 2*e*, 2*f* are equal in each case. In particular, the webs 5 can be arranged between the conductor connection modules 2*a*, 2*b*, 2*c*, 2*d*, 2*e*, 2*f* disposed next to each other in such a way that the webs 5 run on a common straight and/or curved line. However, it is also conceivable that the webs 5 are aligned offset from one another, i.e. do not run on a common line.

However, other initial positions are also conceivable. For example, the conductor connection modules 2*a*, 2*b*, 2*c*, 2*d*, 2*e*, 2*f* of the terminal 1 can also already have an arc-shaped initial position or have a partly linear and partly arc-shaped initial position.

Figure 2:
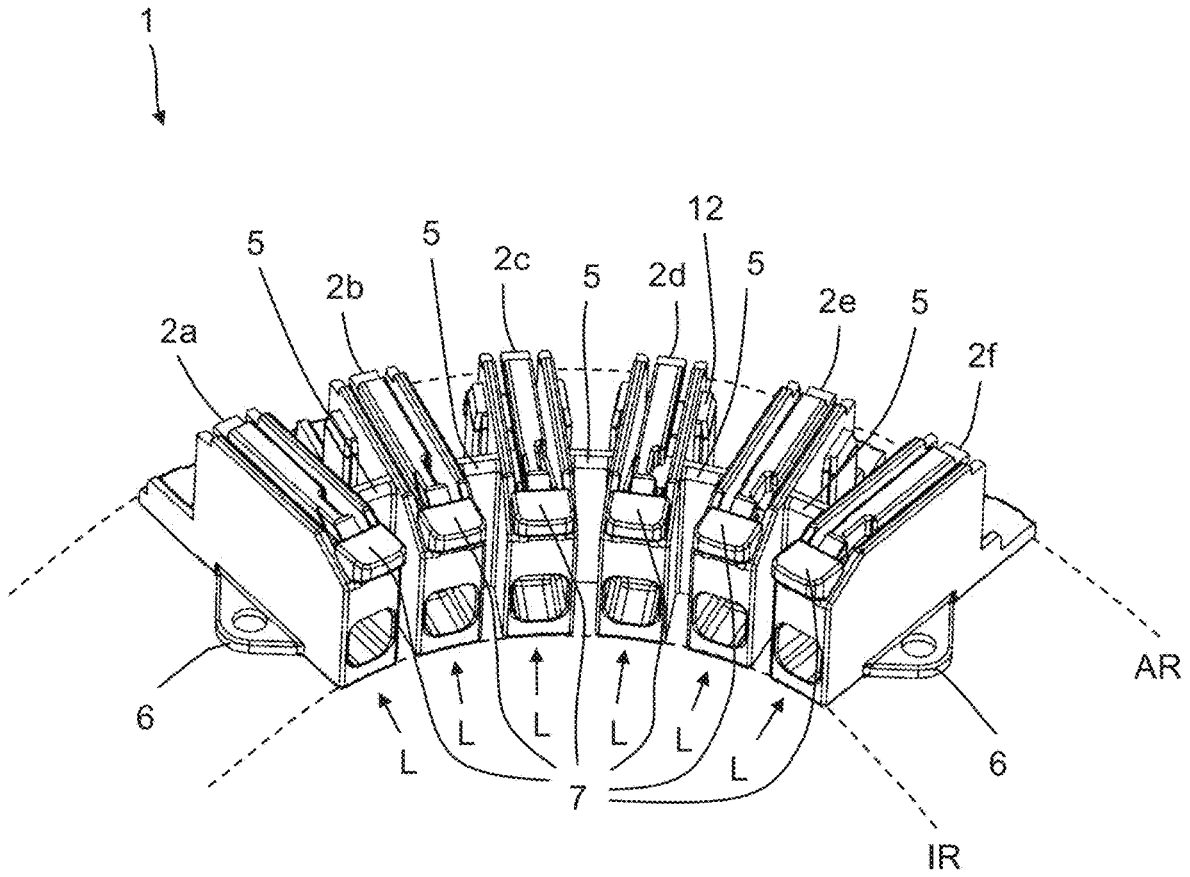
FIG. 2 is a connecting terminal according to FIG. 1 in an arrangement different from the initial position.

FIG. 2 shows a connecting terminal 1 according to FIG. 1 in an arrangement different from the initial position. It is clear that the conductor connection modules 2*a*, 2*b*, 2*c*, 2*d*, 2*e*, 2*f* can be brought into an arrangement different from the initial position in FIG. 1. The position of the conductor connection modules 2*a*, 2*b*, 2*c*, 2*d*, 2*e*, 2*f* has changed from a linear arrangement to an arc-shaped arrangement. The arc-shaped arrangement means in particular that the conductor connection modules are preferably arranged on a common circular arc, the circular arc having an inner radius (IR) and an outer radius (AR).

The displacement of the conductor connection modules 2*a*, 2*b*, 2*c*, 2*d*, 2*e*, 2*f* from an initial position to an arrangement different from the initial position is achieved by the flexibility of the webs 5. The webs 5 are designed to be flexible in such a way that the angle of two adjacent conductor connection modules 2*a*, 2*b*, 2*c*, 2*d*, 2*e*, 2*f* can be changed. However, flexible also means in particular that the conductor connection modules 2*a*, 2*b*, 2*c*, 2*d*, 2*e*, 2*f* can also be returned from the arc-shaped arrangement to the initial position according to FIG. 1 without the webs 5 or the conductor connection modules 2*a*, 2*b*, 2*c*, 2*d*, 2*e*, 2*f* undergoing plastic deformation.

The flexibility of the webs 5 can be achieved, for example, by a suitable selection of materials and/or an appropriate design of the webs 5, for example, by selecting a suitable cross-sectional profile of the webs 5. The webs 5 have a sufficiently high modulus of elasticity so that the conductor connection modules 2*a*, 2*b*, 2*c*, 2*d*, 2*e*, 2*f* can be brought from the initial position according to FIG. 1 into the arc-shaped arrangement according to FIG. 2 with the application of force, wherein after removal of this force the conductor connection modules 2*a*, 2*b*, 2*c*, 2*d*, 2*e*, 2*f* return to their initial position according to FIG. 1.

To ensure that the conductor connection modules 2*a*, 2*b*, 2*c*, 2*d*, 2*e*, 2*f* remain in the arrangement shown in FIG. 2, which differs from the initial position, a mounting tab 6 is arranged on each of the outer conductor connection modules 2*a*, 2*f*. The mounting tab 6 can be used to fix the terminal in the desired position at the mounting location, for example by means of a screw connection.

It is clear that the conductor insertion directions L of the conductor connection modules 2*a*, 2*b*, 2*c*, 2*d*, 2*e*, 2*f* are aligned in a star shape with respect to each other in the arc-shaped arrangement of the conductor connection line according to FIG. 2. Star-shaped means in particular that the conductor insertion directions L have a common alignment, although it is not absolutely necessary that the conductor insertion directions L end exactly in a common alignment.

It can also be seen that an actuating lever 7 is arranged on each conductor connection module 2*a*, 2*b*, 2*c*, 2*d*, 2*e*, 2*f*. The actuating lever 7 interacts with a clamping spring arranged in the interior of the respective conductor connection module 2*a*, 2*b*, 2*c*, 2*d*, 2*e*, 2*f*, which, for example, forms a contact insert with a busbar piece, wherein the clamping spring and the busbar piece form a clamping point for the electrical conductor to be connected. The actuating lever 7 is configured to open and/or close the corresponding clamping point. The contact insert is not shown in this design.

Figure 3:
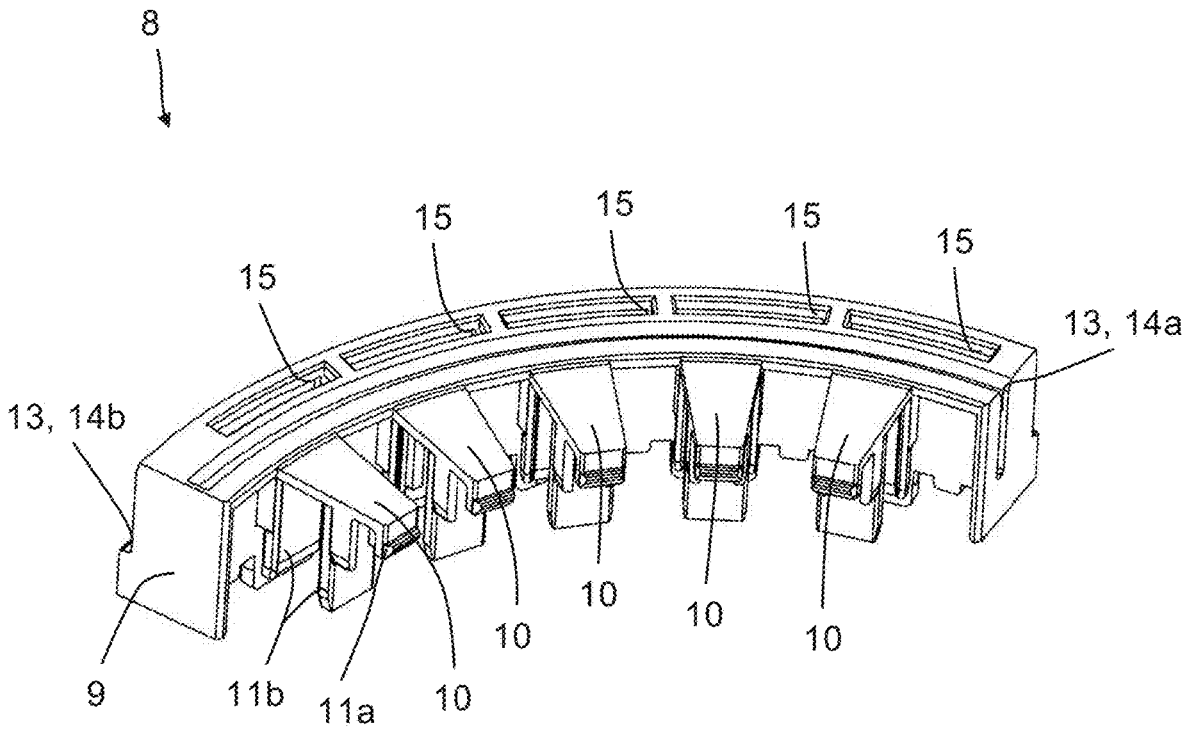
FIG. 3 is an embodiment of a cover element in a perspective plan view.
Figure 4:
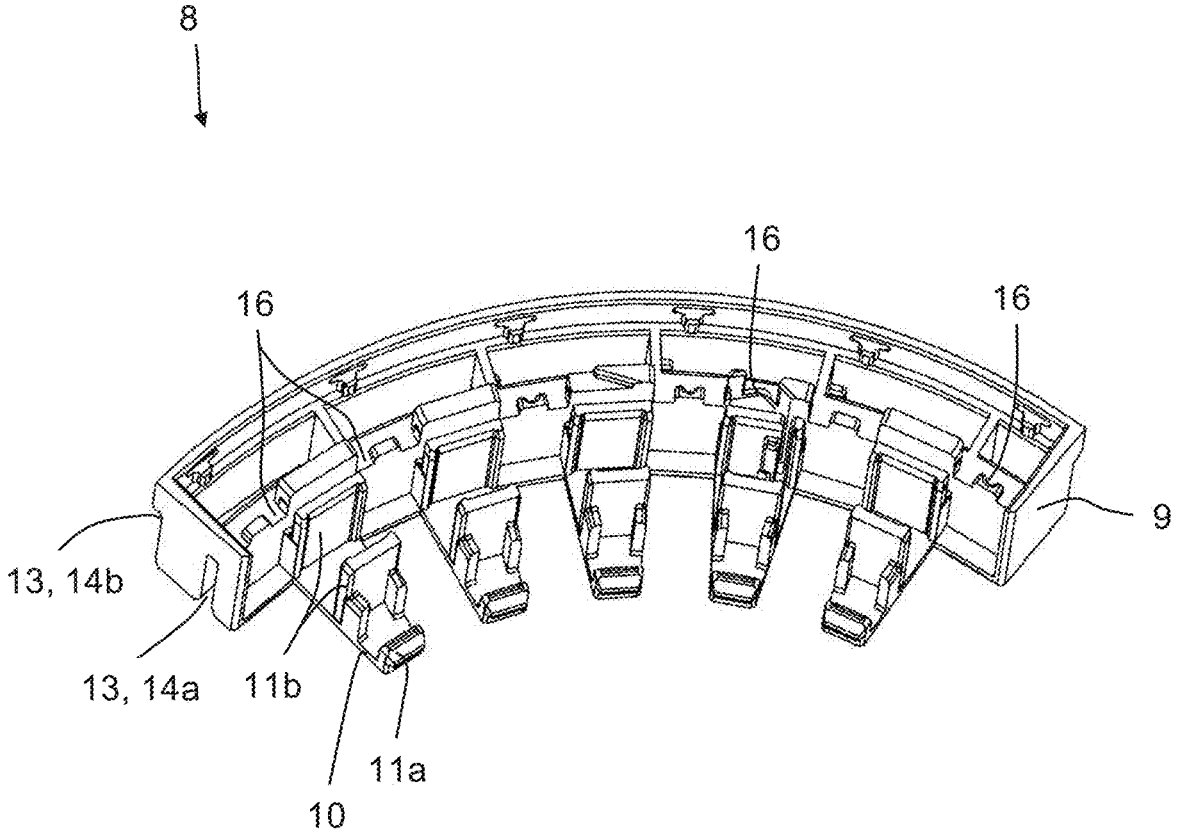
FIG. 4 is a cover element according to FIG. 3 in a perspective bottom view.

FIG. 3 shows a cover element 8 in a perspective plan view and FIG. 4 shows the cover element according to FIG. 3 in a perspective bottom view. The cover element 8 is designed to be fitted on the terminal 1 according to FIGS. 1 and 2.

The cover element 8 has a base body 9, wherein mounting webs 10 project from the base body 9. It is clear that the mounting webs 10 are trapezoidal in shape. This means that the mounting webs 10 can be inserted with a precise fit into the intermediate spaces between two adjacent conductor connection modules 2*a*, 2*b*, 2*c*, 2*d*, 2*e*, 2*f*.

Different types of latching elements 11*a*, 11*b* are arranged on the mounting webs 10. The latching elements 11*a* are arranged at the free end of the mounting webs 10 and are designed in such a way that the latching elements 11*a* interact with the webs 5 of the connecting terminal according to FIGS. 1 and 2 and latch with these after the cover element 8 has been fitted onto the connecting terminal 1.

The latching elements 11*b*, on the other hand, are designed in such a way that they engage in a corresponding dovetail connection 12 of the connecting terminal 1 as shown in FIG. 2, where they ensure a positive connection to the connecting terminal 1.

It is also clear that the cover element 8 has receiving contours 13 for receiving a pin strip. These receiving contours 13 are designed as a groove 14*a* or as a lateral recess 14*b* into which corresponding guide bars of a pin strip can be inserted. Furthermore, the cover element 8 has openings 15 for receiving the pin strip, wherein a contact pin of the pin strip can be guided through each of the openings 15 to a conductor connection module, wherein the contact pin can, for example, make electrically conductive contact with a contact fork of the conductor connection module.

The base body 9 of the cover element 8 is designed on the underside in such a way that bridges for contacting second conductor connection modules or switching springs can be arranged there. These can be arranged in free spaces 16 in such a way that no additional installation space needs to be provided.

Figure 5:
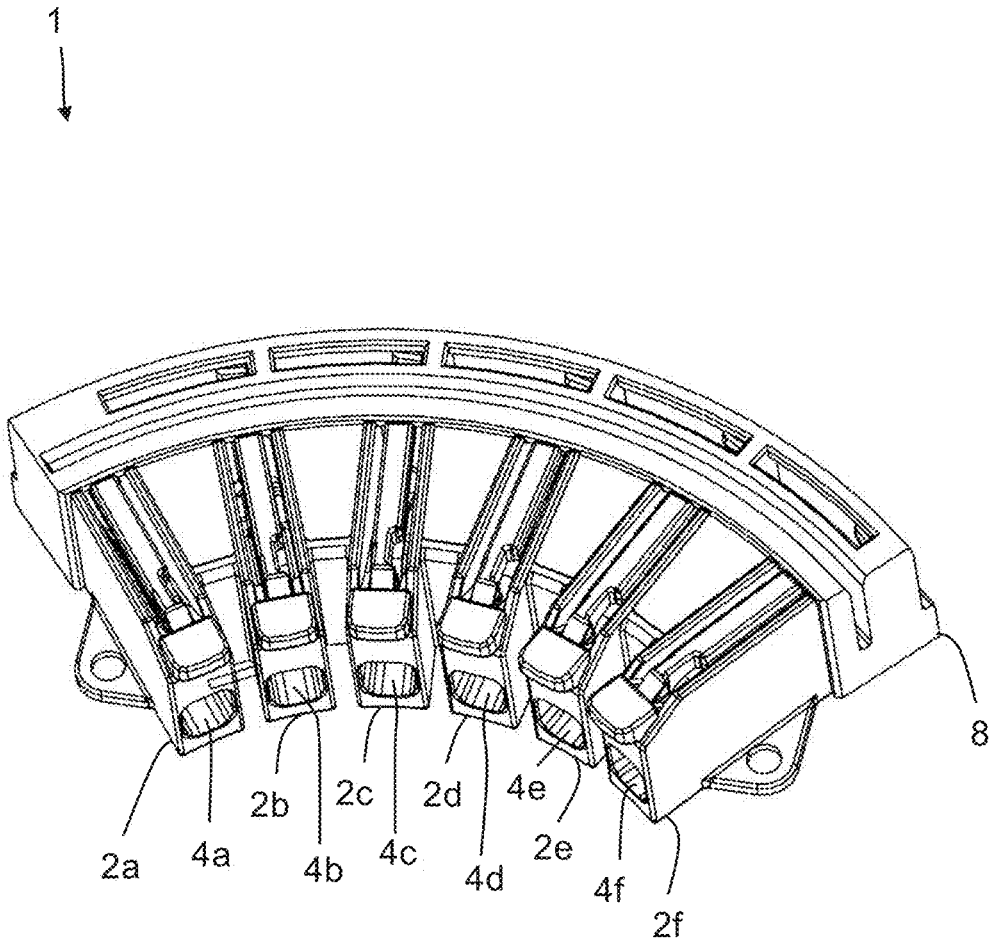
FIG. 5 is a connecting terminal according to FIG. 2 with a cover element plugged according to FIGS. 3 and 4.

FIG. 5 shows a connecting terminal 1 according to FIG. 2 with a mounted cover element 8 as shown in FIGS. 3 and 4. It is clear that the cover element 8 is plugged onto the connecting terminal 1 at the ends of the conductor connection modules 2*a*, 2*b*, 2*c*, 2*d*, 2*e*, 2*f* opposite the conductor insertion openings 4*a*, 4*b*, 4*c*, 4*d*, 4*e*, 4*f*, with the latching elements 11*a*, 11*b* fixing the cover element 8 to the connecting terminal 1.

Furthermore, it is clear that the cover element 8 fixes the conductor connection modules 2*a*, 2*b*, 2*c*, 2*d*, 2*e*, 2*f* in the arc-shaped arrangement different from the initial position. The conductor connection modules 2*a*, 2*b*, 2*c*, 2*d*, 2*e*, 2*f* can no longer be returned to their initial position by the cover element 8, since the fixing webs 10 are arranged between the conductor connection modules 2*a*, 2*b*, 2*c*, 2*d*, 2*e*, 2*f*, as can be seen.

The positional fixing of the conductor connection modules 2*a*, 2*b*, 2*c*, 2*d*, 2*e*, 2*f* by the cover element 8 can be achieved, for example, by the cover element 8 being of rigid design, in contrast to the elastic connection of the conductor connection modules 2*a*, 2*b*, 2*c*, 2*d*, 2*e*, 2*f* to one another via the flexible design of the webs 5. It is thus conceivable that different cover elements 8 are also designed for different applications in order to be able to fix the conductor connection modules 2*a*, 2*b*, 2*c*, 2*d*, 2*e*, 2*f* in desired different end positions.

Figure 6:
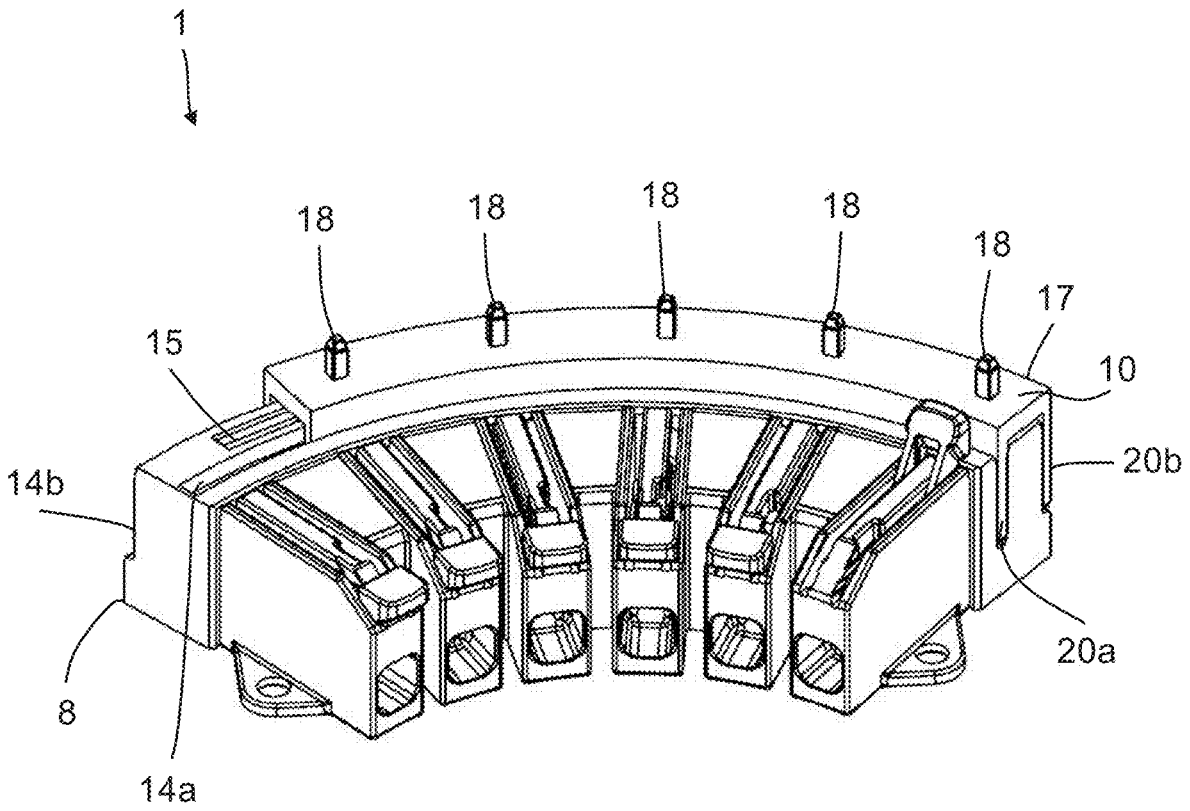
FIG. 6 is a connecting terminal according to FIG. 5 with plugged pin strip.

FIG. 6 shows a connecting terminal 1 according to FIG. 5 with a plugged pin strip 17. The pin strip 17 has several contact pins 18, wherein the contact pins 18 project into the openings 15 of the cover element 8.

It is clear that the pin strip 17 is U-shaped when viewed in cross section, or when looking at the shell end face, wherein two guide webs 20*a*, 20*b* project from a base plate 19. The guide web 20*a* engages in the corresponding groove 14*a* of the cover element 8 and the guide web 20*b* engages in the corresponding recess 14*b* of the cover element 8, so that the pin strip 17 can be reliably mounted on the cover element 8. The sections of the contact pins 18 arranged between the guide webs 20*a*, 20*b* thereby engage in the openings 15 of the cover element 8.

Figure 7:
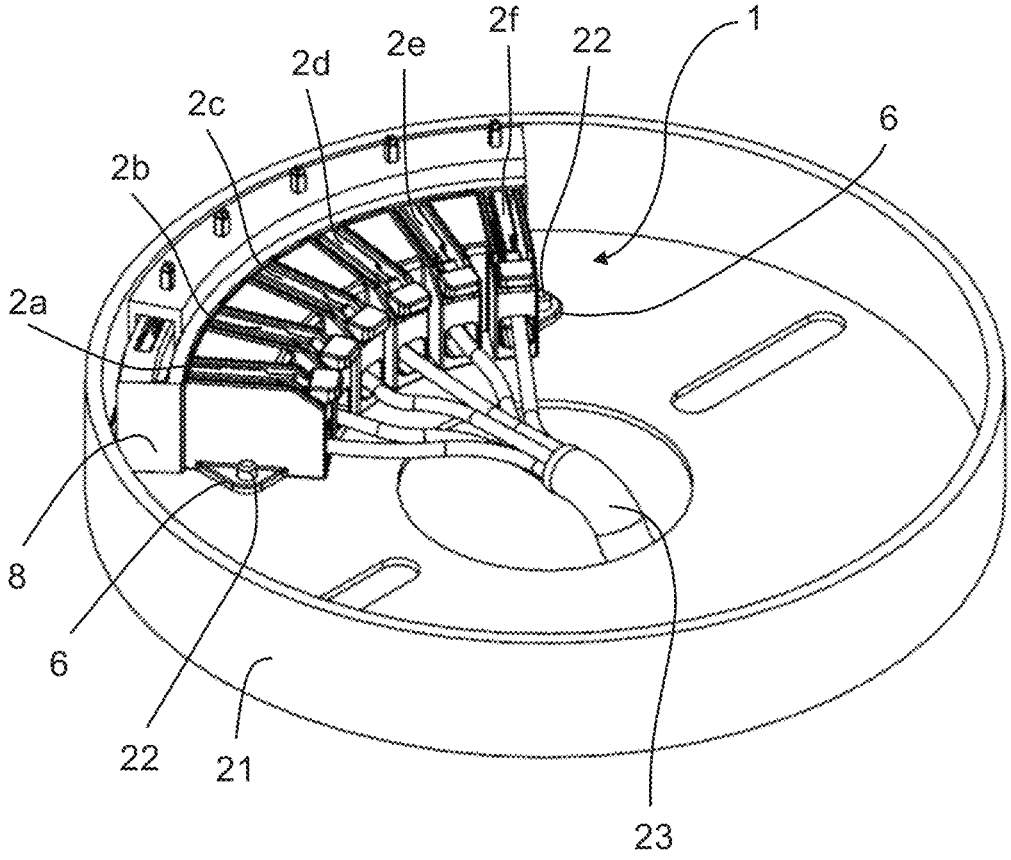
FIG. 7 is an exemplary embodiment of a connecting terminal in a fire detector housing.

FIG. 7 shows an application example of a connecting terminal 1 according to the invention in a fire detector housing 21. It is clear that the conductor connection modules 2*a*, 2*b*, 2*c*, 2*d*, 2*e*, 2*f* are arranged in an arc-shaped arrangement in the fire detector housing 21, wherein the connecting terminal 1 is fastened via mounting tabs 6 to the outer conductor connection modules 2*a*, 2*f* in the fire detector housing 21 by mounting means 22. The mounting means 22 may, for example, be a screw or a rivet. The arc-shaped arrangement of the conductor connection modules 2*a*, 2*b*, 2*c*, 2*d*, 2*e*, 2*f* is thereby adapted to the contour of the fire detector housing 21.

The conductor connection modules 2*a*, 2*b*, 2*c*, 2*d*, 2*e*, 2*f* are fixed via the mounting tabs 6 and the cover element 8 in the arc-shaped arrangement different from the initial position. An electrical conductor is inserted into each of the conductor connection modules 2*a*, 2*b*, 2*c*, 2*d*, 2*e*, 2*f*, wherein the electrical conductors converge in one area and continue as a common The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connecting terminal comprising:

a plurality of conductor connection modules, the plurality of conductor connection modules each have an insulating material housing with a conductor insertion opening to accommodate an electrical conductor; and webs, wherein adjacent conductor connection modules of the plurality of conductor connection modules are connected via the webs, such that each respective one of the webs connects two of the plurality of conductor connection modules that are arranged next to one another, wherein the webs are flexible such that the plurality of conductor connection modules are adapted to be arranged from an initial position into an arrangement different from the initial position, and vice versa, and wherein a cover element is arranged on the connecting terminal, the cover element being designed in such a way as to fix the plurality of conductor connection modules in the arrangement which differs from the initial position, and the cover element being detachably connected to the conductor connection modules.

2. The connecting terminal according to claim 1, wherein the plurality of conductor connection modules and the webs connecting the plurality of conductor connection modules are formed in one piece.

3. The connecting terminal according to claim 1, wherein a contact insert is arranged in at least one of the plurality of conductor connection modules, wherein the contact insert has a busbar piece and a clamping spring for clamping the electrical conductor, and wherein the busbar piece and the clamping spring form a clamping point for the electrical conductor to be clamped.

4. The connecting terminal according to claim 3, wherein a fork contact for making contact with a contact pin is arranged on the busbar piece.

5. The connecting terminal according to claim 3, wherein the busbar piece has a contact opening for receiving a bridge or a switching spring.

6. The connecting terminal according to claim 3, wherein a conductor insertion contour for guiding the electrical conductor projects from the busbar piece.

7. The connecting terminal according to claim 1, wherein the connecting terminal has at least one mounting tab for mounting the connecting terminal to or in another housing.

8. The connecting terminal according to claim 1, wherein mounting webs project from the cover element, wherein the mounting webs project from the cover element into an intermediate space between two adjacent conductor connection modules.

9. The connecting terminal according to claim 8, wherein the mounting webs are trapezoidal in shape.

10. The connecting terminal according to claim 1, wherein at least one latching element is arranged on the cover element and/or on the connecting terminal, wherein the at least one latching element fixes the cover element to the connecting terminal.

11. The connecting terminal according to claim 10, wherein the latching element is formed as a dovetail connection.

12. The connecting terminal according to claim 1, wherein the cover element has a receiving contour for receiving a pin strip.

13. The connecting terminal according to claim 12, wherein the pin strip has contact pins, and wherein the contact pins are designed for making contact with a fork contact.

14. A connecting terminal comprising:

a plurality of conductor connection modules, the plurality of conductor connection modules each have an insulating material housing with a conductor insertion opening to accommodate an electrical conductor; and webs, wherein adjacent conductor connection modules of the plurality of conductor connection modules are connected via the webs, such that each respective one of the webs connects two of the plurality of conductor connection modules that are arranged next to one another, wherein the webs are flexible such that the plurality of conductor connection modules are adapted to be arranged from an initial position into an arrangement different from the initial position, and vice versa, wherein a contact insert is arranged in at least one of the plurality of conductor connection modules, wherein the contact insert has a busbar piece and a clamping spring for clamping the electrical conductor, and wherein the busbar piece and the clamping spring form a clamping point for the electrical conductor to be clamped, and wherein the connecting terminal has an actuating lever, wherein the actuating lever is designed to open and/or close the clamping point.

* * * * *